US011326223B2

(12) United States Patent
Yamamoto et al.

(10) Patent No.: US 11,326,223 B2
(45) Date of Patent: May 10, 2022

(54) METHOD AND DEVICE FOR MANUFACTURING STEAM-TREATED PRODUCTS

(71) Applicant: NIPPON STEEL NISSHIN CO., LTD., Tokyo (JP)

(72) Inventors: Masaki Yamamoto, Tokyo (JP); Yoshinobu Kurisu, Tokyo (JP); Toshiaki Sato, Tokyo (JP); Toyoharu Yasuda, Tokyo (JP); Ichiro Takahashi, Tokyo (JP); Hiroyuki Nakamizo, Tokyo (JP); Tadashi Nakano, Tokyo (JP); Hirokazu Tsuji, Tokyo (JP); Takahide Hayashida, Tokyo (JP); Yoshitaka Yukura, Hiroshima (JP); Tsutomu Ohta, Hiroshima (JP); Shinichi Kajimoto, Hiroshima (JP); Takumi Uchiyama, Hiroshima (JP); Noboru Suzuki, Fukuoka (JP); Masahiko Tsuchiyama, Fukuoka (JP); Yuusuke Murai, Fukuoka (JP)

(73) Assignee: NIPPON STEEL NISSHIN CO., LTD., Tokyo (JP)

( * ) Notice: Subject to any disclaimer, the term of this patent is extended or adjusted under 35 U.S.C. 154(b) by 197 days.

(21) Appl. No.: 16/492,613

(22) PCT Filed: Mar. 29, 2018

(86) PCT No.: PCT/JP2018/013171

§ 371 (c)(1),
(2) Date: Sep. 10, 2019

(87) PCT Pub. No.: WO2018/181685

PCT Pub. Date: Oct. 4, 2018

(65) Prior Publication Data

US 2020/0048728 A1 Feb. 13, 2020

(30) Foreign Application Priority Data

Mar. 31, 2017 (JP) ..... JP2017-072636
Mar. 26, 2018 (JP) ..... JP2018-058868

(51) Int. Cl.
*C21D 9/46* (2006.01)
*C21D 1/767* (2006.01)
(Continued)

(52) U.S. Cl.
CPC ..... *C21D 9/46* (2013.01); *C21D 1/767* (2013.01); *C23C 2/26* (2013.01); *C23C 8/16* (2013.01); *C23C 8/80* (2013.01)

(58) Field of Classification Search
CPC .. C21D 9/46; C21D 1/767; C23C 2/26; C23C 8/16; C23C 8/80
See application file for complete search history.

(56) References Cited

U.S. PATENT DOCUMENTS 4,881,983 A 11/1989 Smith et al.
5,002,009 A * 3/1991 Hayami ..... C21D 9/0062 118/676
(Continued)

FOREIGN PATENT DOCUMENTS

CN 108699666 A 10/2018
EP 3425081 A1 1/2019
(Continued)

OTHER PUBLICATIONS

European Patent Office, European Search Report dated Nov. 24, 2020.
(Continued)

*Primary Examiner* — Robert S Jones, Jr.
*Assistant Examiner* — Jiangtian Xu
(74) *Attorney, Agent, or Firm* — Li & Cai Intellectual Property Office

(57) ABSTRACT

The present invention enables quick cooling of steam-treated objects and thus reduces the manufacturing time of steam-treated products such as black coated steel sheets. The present invention provides a method for manufacturing
(Continued)

steam-treated products, which involves a steam treatment step that introduces steam into a closed container (10) containing a treatment object (1) and brings the treatment object (1) into contact with the steam, and a treated object cooling step that cools the object (1) treated with steam in the steam treatment step, wherein said treated object cooling step introduces coolant gas into said closed container (10), brings said treated object (1) into contact with the coolant gas, and discharges the introduced coolant gas from said closed container (10).

3 Claims, 7 Drawing Sheets

(51) Int. Cl.

| | |
|---|---|
| ***C23C 8/16*** | (2006.01) |
| ***C23C 8/80*** | (2006.01) |
| ***C23C 2/26*** | (2006.01) |

(56) References Cited

U.S. PATENT DOCUMENTS

| | | | | |
|---|---|---|---|---|
| 2013/0118186 | A1* | 5/2013 | Zurecki | C21D 1/767<br>62/62 |
| 2018/0327874 | A1* | 11/2018 | Sugimoto | C21D 1/767 |
| 2019/0062889 | A1* | 2/2019 | Nakano | C22C 18/00 |

FOREIGN PATENT DOCUMENTS

| | | | |
|---|---|---|---|
| EP | 3572552 | A1 | 11/2019 |
| JP | S643492 | A | 1/1989 |
| JP | H08337867 | A | 12/1996 |
| JP | 11241123 | A | 9/1999 |
| JP | 6072952 | B1 | 2/2017 |

OTHER PUBLICATIONS

China Patent Office, Office Action dated Dec. 22, 2020.
Japan Patent Office, Office Action dated Jan. 19, 2021.
Taiwan Patent Office, Office action dated Aug. 19, 2021.

* cited by examiner

METHOD AND DEVICE FOR MANUFACTURING STEAM-TREATED PRODUCTS

BACKGROUND OF THE INVENTION

1. Field of the Invention

The present invention relates to a method and a device for manufacturing steam-treated products such as black coated steel sheets.

2. Description of Related Art

The need for black steel sheets and the like is increasing with design awareness in a number of fields, including roofing and exterior materials for buildings, home appliances and automobiles. For example, patent document 1 describes a method for manufacturing black coated steel sheets.

The method for manufacturing black coated steel sheets in patent document 1 involves a step that brings coated steel sheets into contact with steam in a closed container and thus blackens the coating layer surface, and a step that introduces gas such as outside air into the closed container and thus cools the blackened coated steel sheets.

In this specification, the treatment in which a treatment object such as coated steel sheets has contact with steam in a closed container to blacken the coating layer may be referred to as "steam treatment."

CITATION LIST

Patent Literature

Patent document 1 Japanese Patent No. 6072952

SUMMARY OF INVENTION

Technical Problem

The cooling step for coated steel sheets in patent document 1 is not sufficiently quick, leading to the lengthy manufacturing of black coated steel sheets.

Therefore, the present invention provides a method and a device for manufacturing steam-treated products, allowing quick cooling of steam-treated objects and thus reducing the manufacturing time of steam-treated products such as black coated steel sheets.

Solution to Problem (1) The present invention provides a method for manufacturing steam-treated products, which involves a steam treatment step that introduces steam into a closed container containing a treatment object and brings the treatment object into contact with the steam, and a treated object cooling step that cools the object treated with steam in the steam treatment step, wherein said treated object cooling step introduces coolant gas into said closed container, brings said treated object into contact with the coolant gas, and discharges the introduced coolant gas from said closed container.

In construction (1), the treated object cooling step introduces coolant gas into the closed container, and this coolant gas comes into contact with the treated object that has an increased temperature as a result of steam treatment. Then the coolant gas has an increased temperature through heat exchange during the contact, and this coolant gas is discharged from the closed container. Thus, the coolant gas that has removed heat from the treated object is discharged from the closed container, allowing quick (short-time) cooling of the steam-treated object and thus reducing the manufacturing time of steam-treated products such as black coated steel sheets.

(2) The present invention provides the method for manufacturing steam-treated products according to (1), wherein said treated object cooling step includes a coolant gas introduction step that introduces coolant gas into said closed container and temporarily keeps the introduced coolant gas confined in said closed container, and a coolant gas discharge step that discharges said coolant gas from said closed container using a gas discharge pump or gas discharge pumps after the coolant gas introduction step so that the gas pressure in said closed container goes below the outside air pressure level.

In construction (2), the treated object cooling step includes a coolant gas introduction step and a coolant gas discharge step. In the coolant gas introduction step, the coolant gas removes sufficient heat from the treated object. In the coolant gas discharge step, the coolant gas with an increased temperature due to the heat removal from the treated object is intensively discharged to the outside using a gas discharge pump or gas discharge pumps. Thus, the steam-treated object can be cooled more quickly, which further reduces the manufacturing time of steam-treated products such as black coated steel sheets.

(3) The present invention provides the method for manufacturing steam-treated products according to (2), wherein said treated object cooling step alternately repeats said coolant gas introduction step and said coolant gas discharge step.

In construction (3), the steam-treated object can be cooled more quickly than in construction (2), which further reduces the manufacturing time of steam-treated products such as black coated steel sheets.

(4) The present invention provides the method for manufacturing steam-treated products according to (1), wherein said treated object cooling step introduces coolant gas into said closed container and brings said treated object into contact with the coolant gas, simultaneously discharging the introduced coolant gas from said closed container.

In construction (4), coolant gas is introduced into the closed container and simultaneously the introduced coolant gas is discharged from the closed container. Therefore, the coolant gas with an increased temperature due to the heat removal from the treated object can be smoothly replaced by the coolant gas with a relatively low temperature that is ready for heat removal. Thus, the steam-treated object can be cooled more quickly, which further reduces the manufacturing time of steam-treated products such as black coated steel sheets.

(5) The present invention provides the method for manufacturing steam-treated products according to (1) or (4), wherein said treated object cooling step uses a fan installed in said closed container that stirs and circulates the coolant gas in said closed container.

In construction (5), the stirring and circulation of coolant gas in the closed container allow uniform contact of coolant gas with the treated object and consequently quicker uniform cooling of the treated object.

(6) The present invention provides a device for manufacturing steam-treated products, which comprises a closed container that can contain a treatment object, a steam introduction means that introduces steam into said closed container and brings said treatment object placed in said closed container into contact with the steam, a coolant gas introduction means that introduces coolant gas into said closed container containing said steam-treated object, and a coolant gas discharge means that discharges the introduced coolant gas from said closed container.

In construction (6), as in construction (1), the steam-treated object can be cooled quickly (in a short time), which reduces the manufacturing time of steam-treated products such as black coated steel sheets.

Advantageous Effects of Invention

The present invention enables quick cooling of steam-treated objects, which reduces the manufacturing time of steam-treated products such as black coated steel sheets.

DETAILED DESCRIPTION OF THE PREFERRED EMBODIMENTS

Below is a description of the method and the device for manufacturing steam-treated products according to the present invention. In the description, the steam-treated products to be manufactured are black coated steel sheets.

In this specification, aluminum-magnesium-zinc (Zn—Al—Mg) alloy coated steel sheets may be referred to as "coated steel sheets," and the Zn—Al—Mg alloy coating layer as "the coating layer." "Atmospheric gas" means the gas that is present in the closed container. More specifically, atmospheric gas is a general term indicating outside air, steam, nitrogen gas and so forth. "kPa" is used to indicate absolute pressure.

First Embodiment

Figure 1:
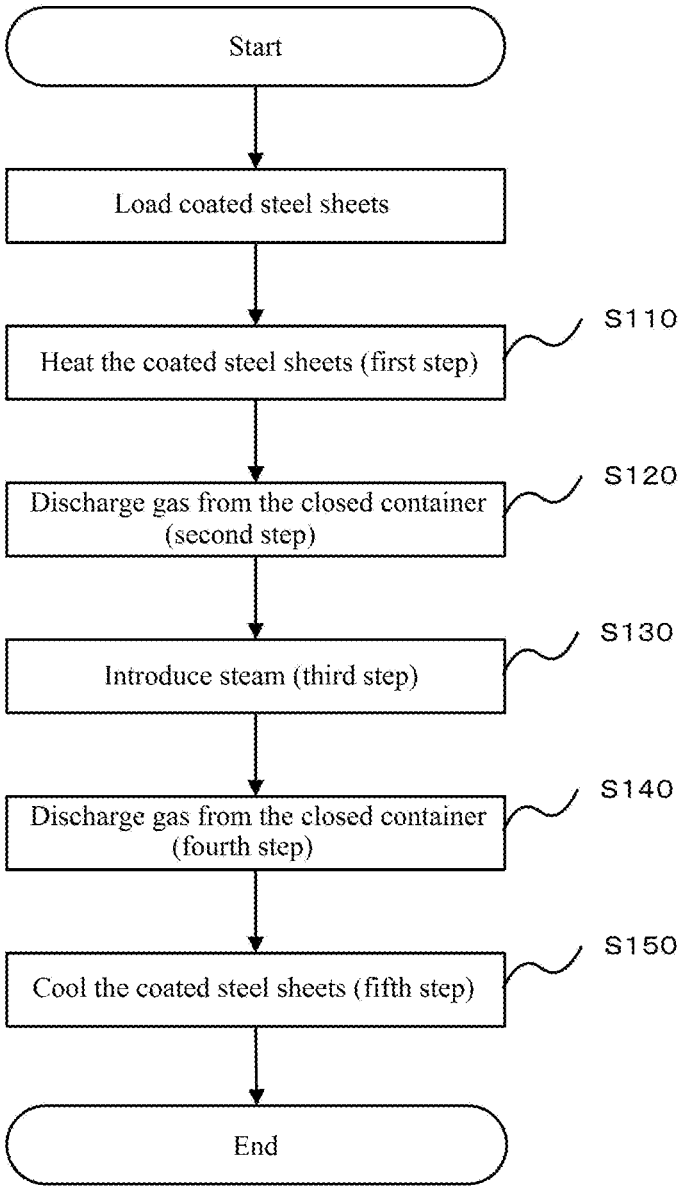
FIG. 1 is a flow chart of the method for manufacturing black coated steel sheets in a first embodiment of the present invention.

In essence, the method for manufacturing steam-treated products in the first embodiment, as shown in FIG. 1, involves a step (S130) that blackens coated steel sheets with steam treatment, and a step (S150) that cools the blackened coated steel sheets, and the cooling step (S150) is the greatest feature. Below is a description of the device for manufacturing black coated steel sheets, designed to perform the cooling step (S150). This description is followed by a detailed description of the cooling step (S150) itself.

(Device for Manufacturing Black Coated Steel Sheets)

(Construction of the Device)

Figure 2:
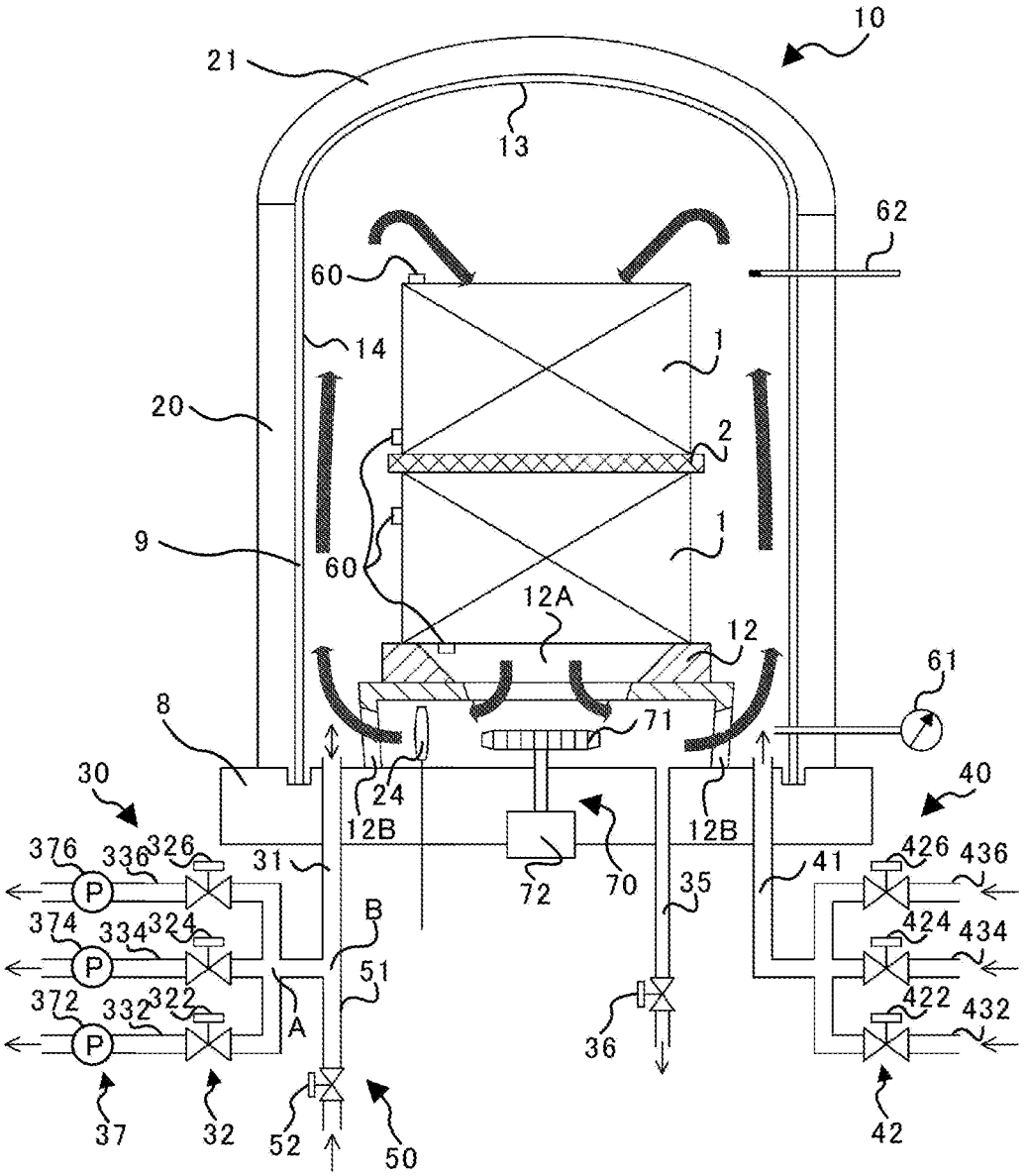
FIG. 2 is a schematic diagram of the device for manufacturing black coated steel sheets in the first embodiment of the present invention.

The device for manufacturing black coated steel sheets in this embodiment (hereafter sometimes referred to as "the black coated steel sheet manufacturing device") shown in FIG. 2, which is a schematic cross-sectional view of an example of the device, comprises a closed container (10) that has a placement part (12) for placing coated steel sheets (1) in a removable manner, a steam introduction regulation mechanism (40) that introduces steam into the closed container (10), a gas introduction part (50) that introduces gas (low-steam gas), whose dew point is lower than the temperature of the coated steel sheets (1), into the closed container (10), and a gas discharge regulation mechanism (30) that discharges atmospheric gas from the closed container (10). The steam introduction regulation mechanism (40) is included in the steam introduction means according to the present invention, the gas introduction part (50) in the coolant gas introduction means, and the gas discharge regulation mechanism (30) in the coolant gas discharge means.

In addition, the black coated steel sheet manufacturing device has an outside air admittance valve (not illustrated) for returning the internal pressure of the closed container (10) to the outside air pressure level, and a stirring unit (70) such as a circulation fan (71) that stirs and circulates the atmospheric gas in the closed container (10).

Furthermore, the black coated steel sheet manufacturing device may have a temperature measurement unit (60) that measures the temperature of the coated steel sheets (1), a pressure measurement unit (61) that measures the internal pressure of the closed container (10), a gas temperature measurement unit (62) that measures the temperature of the atmospheric gas, as well as a ceiling temperature regulation mechanism (21), a vertical wall temperature regulation mechanism (20) and a heating device (24) such as a sheath heater that heat (or cool) the inside of the closed container (10). Besides a steam introduction regulation mechanism (40), a gas introduction part (50), a gas discharge regulation mechanism (30), a stirring unit (70), temperature regulation mechanisms (21, 20), a heating device (24) such as a sheath heater, the black coated steel sheet manufacturing device may have a control unit (not illustrated) that controls the opening and closing of valves in manufacturing black coated steel sheets (1). If the black coated steel sheet manufacturing device has a drain pipe (35) and a drain valve (36), the control unit (90) can control the drain valve (36) to drain water from the device.

Below is a detailed description of an example of the black coated steel sheet manufacturing device with reference to FIG. 2.

The closed container (10) has a bottom frame (8) and an upper cover (9). The bottom frame (8) has a placement part (12) for placing coated steel sheets (1). The upper cover (9) has a ceiling (13) in the form of a dome and a vertical wall (14) in the form of a cylinder. The upper cover (9) is bottomless. Two separate temperature regulation mechanisms are installed on the exterior wall of the closed container (10): a ceiling temperature regulation mechanism (21) and a vertical wall temperature regulation mechanism (20). These temperature regulation mechanisms (21, 20) can heat and cool the inside of the closed container (10) with flowing fluid. The container (10) can be in a closed state to substantially block the inflow of gas from outside or in an open state to receive coated steel sheets (1) from outside. The closed container (10) has strength sufficient to withstand the pressure increase and decrease inside the closed container (10) caused by introducing steam and discharging atmospheric gas as well as heating and cooling.

The bottom frame (8) is connected with a steam supply pipe (41) for introducing steam from a steam supply source, a gas discharge pipe (31) for discharging atmospheric gas and steam from the closed container (10), and a drain pipe (35). An intermediate part of the gas discharge pipe (31) is connected with a gas introduction pipe (51). These pipes (41, 31, 35, 51) have valves. When the valves are closed, the container (10) is in a closed state.

The coated steel sheets (1) are placed in the placement part (12) installed on the bottom frame (8). The coated steel sheets (1) can also be stacked with spacers (2) between them. As shown in FIG. 2, the placement part (12) has inlets (12A) for the atmospheric gas flowing from the upper side to the lower side of the coated steel sheets (1) to be sucked into the circulation fan (71), and outlets (12B) for the atmospheric gas sucked into the circulation fan (71) to be blown out into the internal space of the closed container (10). Because of this construction, the gas in the closed container (10) passes through the gaps between the coated steel sheets (1) and thus circulates, allowing more uniform contact of the atmospheric gas with the coated steel sheets (1).

The gas discharge regulation mechanism (30) has a gas discharge pipe (31), gas discharge valves (32) and gas discharge pumps (37). For example, the gas discharge pumps (37) can be vacuum pumps. The gas discharge valves (32) are a group of gas discharge valves (322, 324, 326) described below. The gas discharge pumps (37) are a group of gas discharge pumps (372, 374, 376) described below. The gas discharge pipe (31) passes through the bottom frame (8) to connect the inside of the closed container (10) to the outside thereof. For example, the atmospheric gas in the closed container (10) is discharged to the outside through the gas discharge pipe (31) with the suction power of the gas discharge pumps (37).

In this embodiment shown in FIG. 2, the gas discharge pipe (31) is composed of one trunk pipe on the upstream side and three branch pipes (332, 334, 336) with different nominal diameters on the downstream side (A is the branching point) along the gas discharge direction. The branch pipes (332, 334, 336) are provided with gas discharge valves (322, 324, 326) and gas discharge pumps (372, 374, 376). The gas discharge pumps (372, 374, 376) are positioned downstream of the gas discharge valves (322, 324, 326) along the gas discharge direction.

For example, the valves (32) of three pipes (332, 334, 336) with nominal diameters of 20A, 25A and 80A can be opened and closed by a control unit for accurate and precise gas discharge regulation based on the required amount of steam in the closed container (10). This is not the only possible embodiment, and the number and nominal diameters of the branch pipes (332, 334, 336) can be altered for specific needs. In the second and fourth steps described below, the gas discharge regulation mechanism (30) can discharge atmospheric gas using the gas discharge pumps (372, 374, 376) so as to bring the gas pressure in the closed container (10) to 70 kPa or less.

The drain pipe (35) passes through the bottom frame (8) to connect the inside of the closed container (10) to the outside thereof. The fluid (dew, etc.) in the closed container (10) is drained to the outside through the drain pipe (35).

The steam introduction regulation mechanism (40) has a steam supply pipe (41) and steam supply valves (42), which serve to adjust the amount of steam to be supplied to the closed container (10). The steam supply valves (42) are a group of steam supply valves (422, 424, 426) described below. When the steam introduction regulation mechanism (40) does not supply steam to the closed container (10), the steam supply valves (42) are closed to block the supply of steam to the closed container (10) through the steam supply pipe (41).

In the black coated steel sheet manufacturing device in this embodiment shown in FIG. 2, the steam supply pipe (41) is composed of one trunk pipe on the downstream side and three branch pipes (432, 434, 436) with different nominal diameters on the upstream side along the steam supply direction to adjust the amount of steam to be supplied to the closed container (10) during steam treatment. The branch pipes (432, 434, 436) are provided with steam supply valves (422, 424, 426).

For example, the valves (42) of the three pipes (432, 434, 436) with nominal diameters of 20A, 25A and 80A can be opened and closed by control for accurate and precise steam introduction regulation based on the required amount of steam in the closed container (10). This is not the only possible embodiment, and the number and nominal diameters of the branch pipes (432, 434, 436) can be altered for specific needs.

The gas introduction part (50) has a gas introduction pipe (51) provided with a gas introduction valve (52). In this embodiment, the downstream end B of the gas introduction pipe (51) along the gas introduction direction is connected to the upstream part (the trunk pipe upstream of the branching point A) of the gas discharge pipe (31) along the gas discharge direction. Thus, the gas introduction pipe (51) leads through the gas discharge pipe (31) to the inside of the closed container (10). In addition, the upstream end of the gas introduction pipe (51) leads from a gas supply source (not illustrated). For example, the gas introduction part (50) can be used to introduce low-steam gas into the closed container (10) in the first and fifth steps (S110, S150) described below.

The temperature measurement unit (60) consists of temperature sensors set in contact with different areas on the surface of the coated steel sheets (1) to measure the temperature of the coated steel sheets (1) using, for example, thermocouples. If the coated steel sheets (1) are in coil form, thermocouples can be inserted between the coiled sheets.

The pressure measurement unit (61) is a pressure gauge for measuring the internal pressure of the closed container (10). This pressure gauge can measure pressure throughout all steps from the first step (S110) to the fifth step (S150) described below.

The gas temperature measurement unit (62) is a temperature sensor that measures the temperature of atmospheric gas in the closed container (10). For example, a thermocouple can be used as the temperature sensor. It is also possible to place some temperature sensors at some points in the closed container (10) so that the temperature sensors are appropriately switched among themselves.

The stirring unit (70) has a circulation fan (71) positioned on the bottom frame (8), and a drive motor (72) that rotates the circulation fan (71). When the drive motor (72) rotates the circulation fan (71), the atmospheric gas passing through the inner diameter part of the coated steel sheets (1), as shown by the arrows in FIG. 2, flows into the inside of the placement part (12) through inlets (12A) in the upper part of the placement part (12) and flows out from the inside of the placement part (12) through outlets (12B) in the lateral portion of the placement part (12). Then the atmospheric gas passes through the gap between the coils (1) and the interior wall of the closed container (10), flows into the gaps between the coated steel sheets (1) from the upper side of the coated steel sheets (1) and again flows into the inside of the placement part (12) from the lower side of the coated steel sheets (1) through the inlets (12A) in the upper portion of the placement part (12) to be sucked into the circulation fan (71) for further circulation in the closed container (10). Thus, the atmospheric gas in the closed container (10) during steam treatment is stirred and supplied to the whole of the coated steel sheets (1). The stirring unit (70) can be used during steam treatment (the third step (S130) described below) as well as in the heating step (the first step (S110) described below) and the cooling step (the fifth step (S150) described below) for the coated steel sheets (1).

(Method for Manufacturing Black Coated Steel Sheets)

Below is a description of the method for manufacturing black coated steel sheets, which brings Zn—Al—Mg alloy coated steel sheets (1) into contact with steam in a closed container (10) using the black coated steel sheet manufacturing device described above to manufacture black coated steel sheets.

The method for manufacturing black coated steel sheets in this embodiment shown in a flow chart in FIG. 1 involves five steps: first step (S110)—heating Zn—Al—Mg alloy coated steel sheets (1) placed (loaded) in a closed container (10) (see FIG. 2); second step (S120) discharging atmospheric gas from the closed container (10) and thus bringing the gas pressure in the closed container (10) to 70 kPa or less; third step (S130)—introducing steam into the closed container (10) and treating the coated steel sheets (1) with the steam; fourth step (S140)—returning the internal pressure of the closed container (10) to the outside air pressure level and then bringing the gas pressure in the closed container (10) to 70 kPa or less again; fifth step (S150)—cooling the coated steel sheets (1) in the closed container (10). Note that in the description below, a control unit outside the figure sending control signals controls the operation of a heating device (24), temperature regulation mechanisms (20, 21), a stirring device (70), valves (32, 42, 52) and gas discharge pumps (37), among other things.

Below is a detailed description of the respective steps.

(First Step)

The first step (S110) heats the coated steel sheets (1) placed in the closed container (10).

The coated steel sheets (1) have a substrate steel sheet and a Zn—Al—Mg alloy coating layer formed on the surface of the substrate steel sheet.

There are no special restrictions on the type of substrate steel sheet. For example, the substrate steel sheet may be low carbon steel, medium carbon steel, high carbon steel or alloy steel. If good press formability is required, deep drawing steel sheets, for example steel sheets of low carbon steel with Ti or Nb added, are preferable as substrate steel sheets. High-strength steel sheets containing P, Si, Mn or the like are also possible.

The Zn—Al—Mg alloy coating layer should have a composition that causes blackening when the coating layer is in contact with steam. For example, Zn—Al—Mg alloy coating layers containing 0.1 to 60 wt % of Al and 0.01 to 10 wt % of Mg, when in contact with steam, suitably blacken.

There are no special restrictions on the form of the coated steel sheets (1) if the coating layer in the area to be blackened can have contact with steam. For example, the coated steel sheets (1) can have a flat coating layer (e.g., plate form) or a curved coating layer (e.g., coil form).

In the first step (S110), the coated steel sheets (1) are heated in the presence of gas (low-steam gas) whose dew point at all times is lower than the temperature of the coated steel sheets (1). Thus, the atmospheric gas that is present in the closed container (10) is low-steam gas. The low-steam gas can be outside air to facilitate the heating of the coated steel sheets (1), but it can also be inert gas such as nitrogen, if the coated steel sheets (1) can be blackened, or atmosphere whose dew point is lower than that of outside air. The low-steam gas can be introduced into the closed container (10) through a gas introduction part (50) connected to the closed container (10).

In the first step (S110), the coated steel sheets (1) are heated until the surface temperature of the coating layer reaches the temperature at which the coating layer is blackened in contact with steam (hereafter sometimes referred to as "blackening temperature"). For example, the surface temperature of the coated steel sheets (1) placed in the closed container (10) can be measured with a temperature measurement unit (60) when the coated steel sheets are heated to the blackening temperature and above.

The blackening temperature can be optionally adjusted depending on the composition (e.g., amounts of Al and Mg in the coating layer) or thickness of the coating layer, the required lightness, and so forth.

There are no special restrictions on the heating method for coated steel sheets (1) if the surface of the coating layer can reach the blackening temperature. For example, the coated steel sheets (1) can be heated in such a manner that a heating device (24), such as a sheath heater, installed in the closed container (10) heats the atmospheric gas in the closed container (10) and consequently the coated steel sheets (1).

The stirring device (70), such as a circulation fan (71), installed in the closed container (10) can stir the atmospheric gas being heated in the closed container (10). This allows quick, effective and uniform heating of the coated steel sheets (1).

(Second Step)

The second step (S120) discharges atmospheric gas from the closed container (10) through the gas discharge pipe (31) and thus brings the gas pressure in the closed container (10) to 70 kPa or less. For example, gas discharge pumps (37) (not illustrated) installed outside the closed container (10) can serve to discharge atmospheric gas from the closed container (10), bringing the gas pressure in the closed container (10) to the aforementioned range. The discharge of atmospheric gas in the second step (S120) can be performed once or more than once. In the latter case, the discharge of atmospheric gas and the introduction of low-steam gas through the gas introduction pipe (51) can be repeated to further reduce the amount of the gas components other than steam remaining in the closed container (10).

The second step (S120) discharges atmospheric gas from the closed container (10) and thus reduces the gas pressure in the closed container (10) so that the gaps between the coated steel sheets (1) can receive a sufficient supply of the steam introduced in the third step (S130) described below. This allows more uniform steam treatment of the whole coating layer and most probably uniform blackening thereof. For this reason, the second step (S120) reduces the gas pressure in the closed container (10) preferably to 70 kPa or less, more preferably to 50 kPa or less.

(Third Step)

The third step (S130) introduces steam into the closed container (10) and blackens the coating layer of the coated steel sheets (1). Thus, the third step (S130) performs steam treatment for the coated steel sheets (1). The third step (S130) is included in the steam treatment step according to the present invention.

In the third step (S130), the atmospheric temperature in the closed container (10) during steam treatment is preferably 105° C. or more. Atmospheric temperature in this range allows quicker blackening. "Atmospheric temperature" in this specification means the temperature of atmospheric gas in the closed container (10). The atmospheric temperature can be measured with a gas temperature measurement unit (62) installed in the closed container (10).

In the third step (S130), the atmospheric gas in the closed container (10) can be stirred by the stirring unit (70) during the blackening after or while introducing steam into the closed container (10) to prevent non-uniform blackening of the coated steel sheets (1).

The time of steam treatment can be optionally adjusted depending on the composition (e.g., amounts of Al and Mg in the coating layer) or thickness of the coating layer, the required lightness, and so forth. However, the time of steam treatment is preferably 24 or so hours.

(Fourth Step)

The fourth step (S140) returns the internal pressure of the closed container (10) to the outside air pressure level and then discharges atmospheric gas from the closed container (10) to bring the gas pressure in the closed container (10) to 70 kPa or less. For example, the internal pressure of the closed container (10) can be returned to the outside air pressure level by opening the outside air admittance valve (not illustrated) provided to the closed container (10). The gas pressure in the closed container (10) can be brought to 70 kPa or less by using the gas discharge pumps (37) installed outside the closed container (10) to discharge atmospheric gas from the closed container (10) through the gas discharge pipe (31).

(Fifth Step)

The fifth step (S150) cools the coated steel sheets (1) by introducing gas (low-steam gas), whose dew point is lower than the temperature of the coated steel sheets (1) at all times, into the closed container (10) through the gas introduction pipe (51), bringing the coated steel sheets (1) with the low-steam gas and discharging the introduced low-steam gas from the closed container (10). The fifth step (S150) is included in the treated object cooling step according to the present invention. Low-steam gas is included in the coolant gas according to the present invention. The gas to be introduced in the fifth step (S150) is preferably unheated, but if necessary, the gas can be heated to the extent that its temperature does not reach the temperature of the atmosphere in the closed container (10).

For example, the low-steam gas to be introduced in the fifth step (S150) can be outside air, nitrogen gas or inert gas. In consideration of workability, the preference is to introduce outside air.

The fifth step (S150) includes a low-steam gas introduction step that introduces low-steam gas into the closed container (10) and keeps the introduced low-steam gas confined in the closed container (10), and an atmospheric gas discharge step that discharges atmospheric gas (containing the introduced low-steam gas) to the outside using the gas discharge pumps (37) after the low-steam gas introduction step so that the gas pressure in the closed container (10) goes below the outside air pressure level. The low-steam gas introduction step is included in the coolant gas introduction step according to the present invention. The atmospheric gas discharge step is included in the coolant gas discharge step according to the present invention. The low-steam gas introduction step and the atmospheric gas discharge step are preferably repeated alternately to speed up the cooling.

Figure 3:
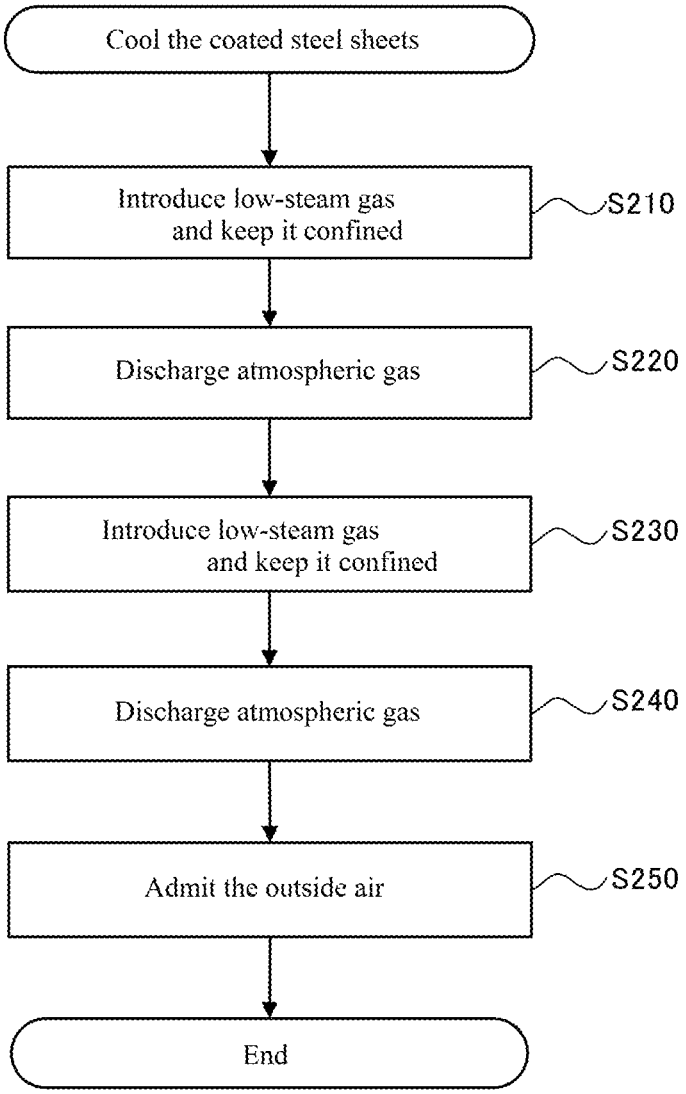
FIG. 3 is a flow chart showing the cooling step for coated steel sheets in the first embodiment.

FIG. 3 is a flow chart showing the details of the fifth step (S150) in FIG. 1. The example in FIG. 3 performs the low-steam gas introduction step and the atmospheric gas discharge step twice alternately: low-steam gas introduction step (S210)→atmospheric gas discharge step (S220)→low-steam gas introduction step (S230)→atmospheric gas discharge step (S240). After the last atmospheric gas discharge step (S240), the inside of the closed container (10) is exposed to the outside air by opening the outside air admittance valve outside the figure (S250). There are no special restrictions on the number of the low-steam gas introduction steps and the atmospheric gas discharge steps. These steps can be performed once, twice or more.

Figure 4:
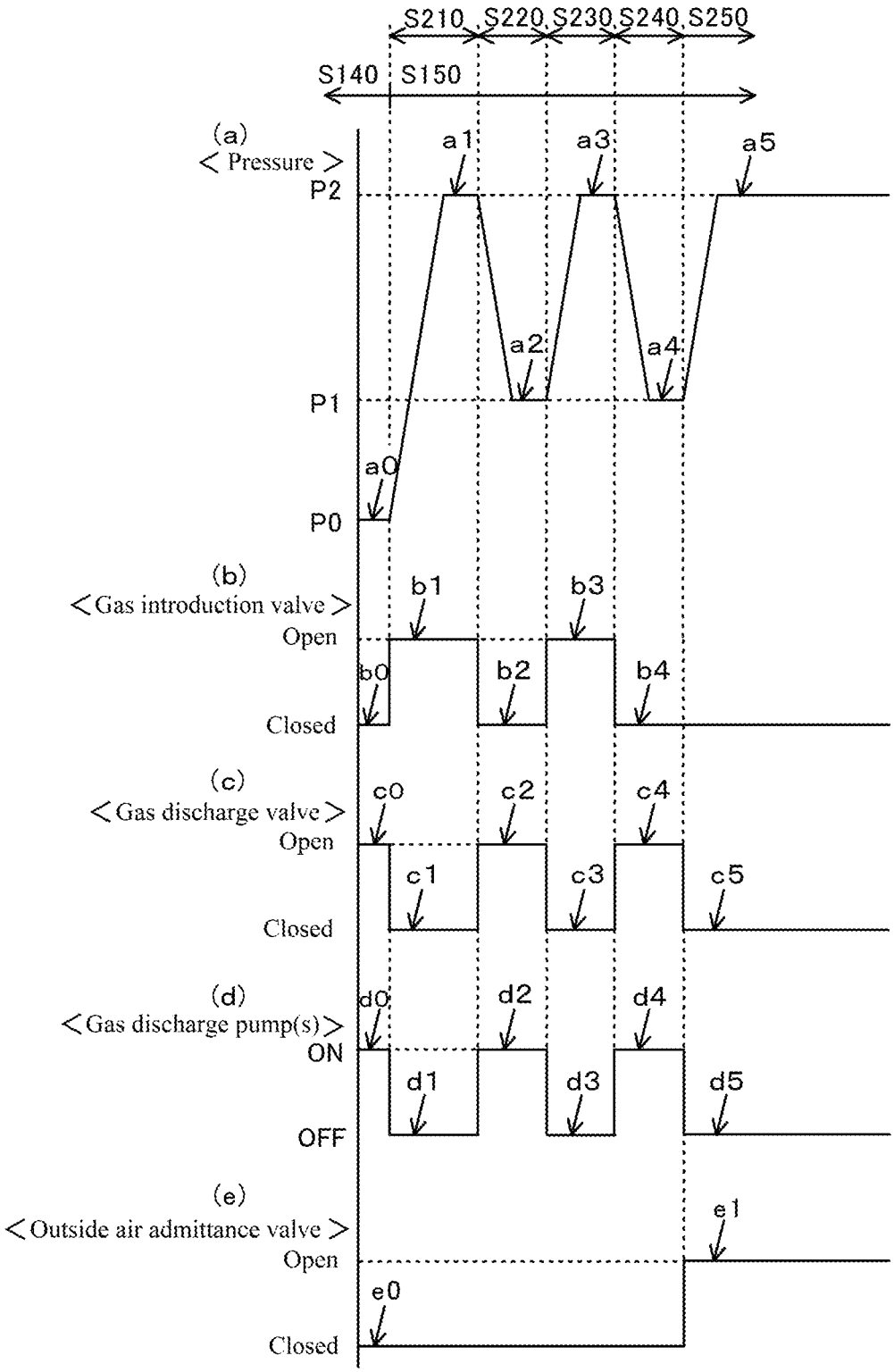
FIG. 4 is a timing chart showing the relationship among (a) change in the internal pressure of the closed container, (b) opening/closing timing for the gas introduction valve, (c) opening/closing timing for the gas discharge valves, (d) on/off timing for the gas discharge pumps and (e) opening/closing timing for the outside air admittance valve in the cooling step for coated steel sheets in the first embodiment.

FIG. 4 is a timing chart showing the relationship among (a) change in the internal pressure of the closed container (10) (measured by the pressure measurement unit (61)), (b) opening/closing timing for the gas introduction valve (52), (c) opening/closing timing for the gas discharge valves (32), (d) on/off timing for the gas discharge pumps (37) and (e) opening/closing timing for the outside air admittance valve from the final stage of the fourth step (S140) to the fifth step (S150). The following is a detailed description of the final stage of the fourth step (S140) and the fifth step (S150).

(Final Stage of the Fourth Step)

In the example in FIG. 4, the fourth step (S140), when reducing the gas pressure in the closed container (10) to 70 kPa or less (see pressure P0, state a0 in (a)), closes the gas introduction valve (52) (see state b0 in (b)), turns on the gas discharge pump(s) (37) (see state d0 in (d)) and opens the gas discharge valve(s) (32) (see state c0 in (c)). The outside air admittance valve is closed (see state e0 in (e)). Gas is discharged through at least one of the three pipes (332, 334, 336). It is not absolutely necessary to turn on all gas discharge pumps (37) and open all gas discharge valves (32).

(Low-Steam Gas Introduction Step)

Next, the low-steam gas introduction step (S210) included in the fifth step (S150) starts. The example in FIG. 4 closes all gas discharge valves (32) (see state c1 in (c)), turns off all gas discharge pumps (37) (see state d1 in (d)), and opens the gas introduction valve (52) (see state b1 in (b)). Through these actions, the low-steam gas introduction step introduces low-steam gas into the closed container (10) and temporarily keeps the introduced low-steam gas confined in the closed container (10), raising the gas pressure in the closed container (10) to the outside air pressure level P2 (see state a1 in (a)). By introducing low-steam gas into the closed container (10) and temporarily keeping the introduced low-steam gas confined in the closed container (10), the coated steel sheets (1) are given sufficient contact with low-steam gas, during which the heat of the coated steel sheets (1) is sufficiently removed by the low-steam gas through heat exchange.

(Atmospheric Gas Discharge Step)

Next, the atmospheric gas discharge step (S220) starts. This step closes the gas introduction valve (52) (see state b2 in (b)), turns on the gas discharge pump(s) (37) (see state d2 in (d)), and opens the gas discharge valve(s) (32) (see state c2 in (c)). These states are maintained until the gas pressure in the closed container (10) decreases to pressure P1, half of pressure P2 or less (see state a2 in (a)). This means that half or more of the gas (atmospheric gas containing low-steam gas) in the closed container (10) is discharged. The example in (a) in FIG. 4 reduces the gas pressure in the closed container (10) to less than half of pressure P2. The atmospheric gas is discharged with low-steam gas from the closed container (10). Gas is discharged through at least one of the three pipes (332, 334, 336). It is not absolutely necessary to turn on all gas discharge pumps (37) and open all gas discharge valves (32). The same is true in the atmospheric gas discharge step (S240) to be performed later.

(Low-Steam Gas Introduction Step)

Next, the low-steam gas introduction step (S230) starts. This step closes all gas discharge valves (32) (see state c3 in (c)), turns off all gas discharge pumps (37) (see state d3 in (d)), and opens the gas introduction valve (52) (see state b3 in (b)). Through these actions, the low-steam gas introduction step (S230) introduces low-steam gas into the closed container (10) and temporarily keeps the introduced low-steam gas confined in the closed container (10), raising the gas pressure in the closed container (10) to pressure P2 (see state a3 in (a)). Thus, the heat of the coated steel sheets (1) is sufficiently removed by the low-steam gas. In this step, the gas discharge pump(s) (37) may remain on (instead of turning it (them) off) if the gas discharge valves (32) are closed to block the gas discharge.

(Atmospheric Gas Discharge Step)

Next, the atmospheric gas discharge step (S240) starts. This step closes the gas introduction valve (52) (see state b4 in (b)), turns on the gas discharge pump(s) (37) (see state d4 in (d)), and opens the gas discharge valve(s) (32) (see state c4 in (c)). These states are maintained until the gas pressure in the closed container (10) decreases to pressure P1, half of pressure P2 or less (see state a4 in (a)). The example in (a) in FIG. 4 reduces the gas pressure in the closed container (10) to less than half of pressure P2. The atmospheric gas is discharged with low-steam gas from the closed container (10).

(Outside Air Admittance Step)

Next, the outside air admittance step (S250) starts. This step closes all gas discharge valves (32) (see state c5 in (c)), turns off all gas discharge pumps (37) (see state d5 in (d)), and opens the outside air admittance valve outside the figure (see state e1 in (e)). Through these actions, the inside of the closed container (10) is exposed to the outside air (see state a5 in (a)).

Effects of the First Embodiment

In the first embodiment, the fifth step (S150) introduces low-steam gas into the closed container (10) and brings the coated steel sheets (1) into contact with the low-steam gas, during which the heat of the coated steel sheets (1) is removed by the low-steam gas through heat exchange. Then the low-steam gas with an increased temperature due to the heat removal from the coated steel sheets (1) is discharged from the closed container (10). Thus, the low-steam gas that has removed heat from the coated steel sheets (1) is discharged from the closed container (10), allowing quick (short-time) cooling of the steam-treated coated steel sheets (1) and thus reducing the manufacturing time of black coated steel sheets.

The low-steam gas introduced into the closed container (10) is temporarily kept confined in the closed container (10). This allows the low-steam gas to remove sufficient heat from the coated steel sheets (1). Then the low-steam gas with an increased temperature due to the heat removal from the coated steel sheets (1) is intensively discharged to the outside using a gas discharge pump or gas discharge pumps (37). This effectively speeds up the cooling of the steam-treated coated steel sheets (1) and greatly reduces the manufacturing time of black coated steel sheets.

In this embodiment shown in FIGS. 3 and 4, the introduction of low-steam gas with subsequent temporary confinement and the discharge of the introduced low-steam gas are performed alternately, which effectively speeds up the cooling of the coated steel sheets (1).

In this embodiment, the fifth step (S150) can use the stirring device (70) such as a circulation fan (71) installed in the closed container (10) to stir the atmospheric gas (containing low-steam gas), which further improves the quick, effective and uniform cooling of the coated steel sheets (1).

Second Embodiment

Figure 5:
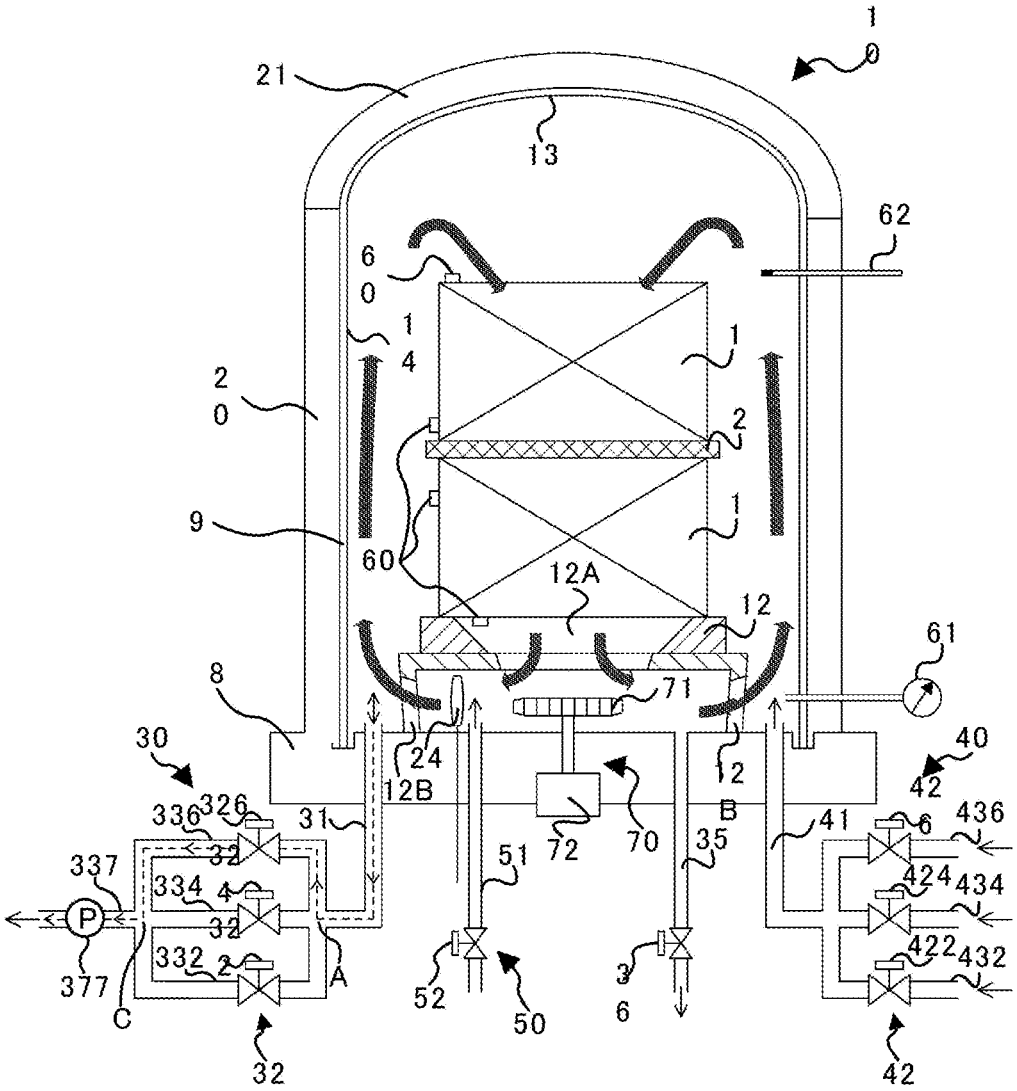
FIG. 5 is a schematic diagram of the device for manufacturing black coated steel sheets in a second embodiment of the present invention.

In the first embodiment, the gas introduction pipe (51) is connected to the gas discharge pipe (31). FIG. 5 shows an alternative placement of the gas introduction pipe (51), which passes through the bottom frame (8) to connect the inside of the closed container (10) to the outside thereof. In this case, the gas introduction pipe (51) and the gas discharge pipe (31) are independent of each other. Therefore, the fifth step (S150) can be performed, for example, in the following manner.

Specifically, the gas introduction valve (52) and the gas discharge valve(s) (32) are opened at the same time. Thus, the fifth step (S150) introduces low-steam gas into the closed container (10) through the gas introduction pipe (51) and brings the coated steel sheets (1) into contact with the low-steam gas, simultaneously discharging the introduced low-steam gas from the closed container (10) through the gas discharge pipe (31).

Effects of the Second Embodiment

In the second embodiment, the introduction and discharge of low-steam gas are performed simultaneously. Therefore, in the closed container (10), the low-steam gas with an increased temperature due to the heat removal from the coated steel sheets (1) is smoothly replaced by the low-steam gas with a relatively low temperature that is ready for heat removal. Thus, the steam-treated coated steel sheets (1) can be cooled more quickly, which reduces the manufacturing time of black coated steel sheets.

As shown in FIG. 5, the branch pipes (332, 334, 336) may join together on the downstream side of the gas discharge valves (322, 324, 326). In the example shown in FIG. 5, the branch pipes (332, 334, 336) of the gas discharge pipe (31) are united at joining point C into a single pipe (337). This single pipe (337) is provided with one gas discharge pump (377). Thus, one pump (377) may serve for the three pipes (332, 334, 336) (a three-pipe system). The dotted arrow in FIG. 5 running in the gas discharge pipe (31) indicates the flow of atmospheric gas (discharge gas) when two gas discharge valves (322, 324) are closed, and one gas discharge valve (326) is open. The discharge rate through the gas discharge pipe (31) can be adjusted by opening any of the gas discharge valves (322, 324, 326).

The first and second embodiments use a gas discharge pipe (31) with branching (A is the branching point), but a gas discharge pipe without branching is also possible. In this case, one gas discharge pump and one gas discharge valve will do for the gas discharge pipe (31).

Modified Example of the Second Embodiment

Figure 6:
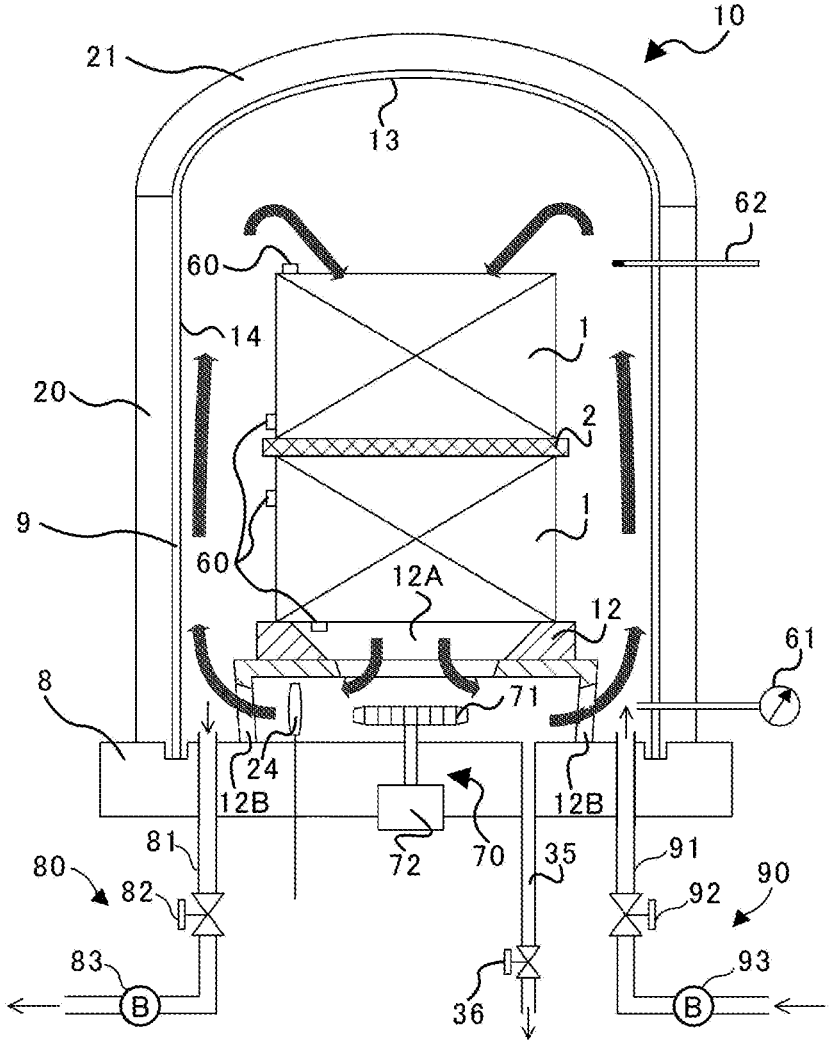
FIG. 6 is a schematic diagram of a device for manufacturing black coated steel sheets as a modified example of the second embodiment of the present invention.

This modified example shares a common feature with the second embodiment described above: low-steam gas is introduced into the closed container (10) at the same time as the introduced low-steam is discharged from the closed container (10). However, this modified example is different from the second embodiment in the structure for introducing low-steam gas and the structure for discharging atmospheric gas. Below is a description of the modified example of the second embodiment with reference to FIGS. 6 and 7.

The modified example of the second embodiment has a gas introduction part (90) (see FIG. 6) instead of the gas introduction part (50) in the second embodiment, and a gas discharge regulation mechanism (80). Note that the modified example of the second embodiment has mechanisms corresponding to the steam introduction regulation mechanism (40) and the gas discharge regulation mechanism (30) in the second embodiment, but these mechanisms are not illustrated in FIG. 6 for the purpose of convenience.

The gas introduction part (90) has a gas introduction pipe (91) that is provided with a gas introduction valve (92) and a forced draft blower (93). The gas introduction pipe (91) passes through the bottom frame (8) to connect the inside of the closed container (10) with the outside thereof. The upstream end of the gas introduction pipe (91) along the flow direction of the introduced low-steam gas leads from a gas supply source (not illustrated). For example, the gas introduction part (90) can be used to introduce low-steam gas into the closed container (10) in the first step (S110) described above and the fifth step (S300) described below.

For example, the low-steam gas to be introduced in the fifth step can be outside air, nitrogen gas or inert gas. In consideration of workability, the preference is to introduce outside air.

The gas discharge regulation mechanism (80) has a gas discharge pipe (81), a gas discharge valve (82) and an induced draft blower (83). The gas discharge pipe (81) passes through the bottom frame (8) to connect the inside of the closed container (10) to the outside thereof. For example, the atmospheric gas in the closed container (10) is discharged to the outside through the gas discharge pipe (81) with the suction power of the induced draft blower (83). For example, the gas discharge regulation mechanism (80) can be used to discharge atmospheric gas from the closed container (10) in the fifth step (S300) described below.

The following describes the fifth step in the modified example of the second embodiment. The fifth step introduces gas (low-steam gas), whose dew point is lower than the temperature of the coated steel sheets (1) at all times, into the closed container (10) through the gas introduction pipe (91), brings the coated steel sheets (1) into contact with the low-steam gas, and discharges the introduced low-steam gas from the closed container (10), thus cooling the coated steel sheets (1).

The fifth step introduces low-steam gas into the closed container (10) and brings the coated steel sheets (1) into contact with the low-steam gas, simultaneously discharging the introduced gas from the closed container (10).

Specifically, the fifth step includes a low-steam gas introduction step that introduces low-steam gas into the closed container (10) until the gas pressure in the closed container (10) reaches the outside air pressure level, a low-steam introduction/atmospheric gas discharge step that, after the low-steam gas introduction step, continues to introduce low-steam gas into the closed container (10) and bring the coated steel sheets (1) into contact with the low-steam gas, simultaneously discharging atmospheric gas (containing the introduced low-steam gas) from the closed container (10) so as to maintain the gas pressure in the closed container (10) at the outside air pressure level, and a finish step that finishes the fifth step, maintaining the gas pressure in the closed container (10) at the outside air pressure level.

Figure 7:
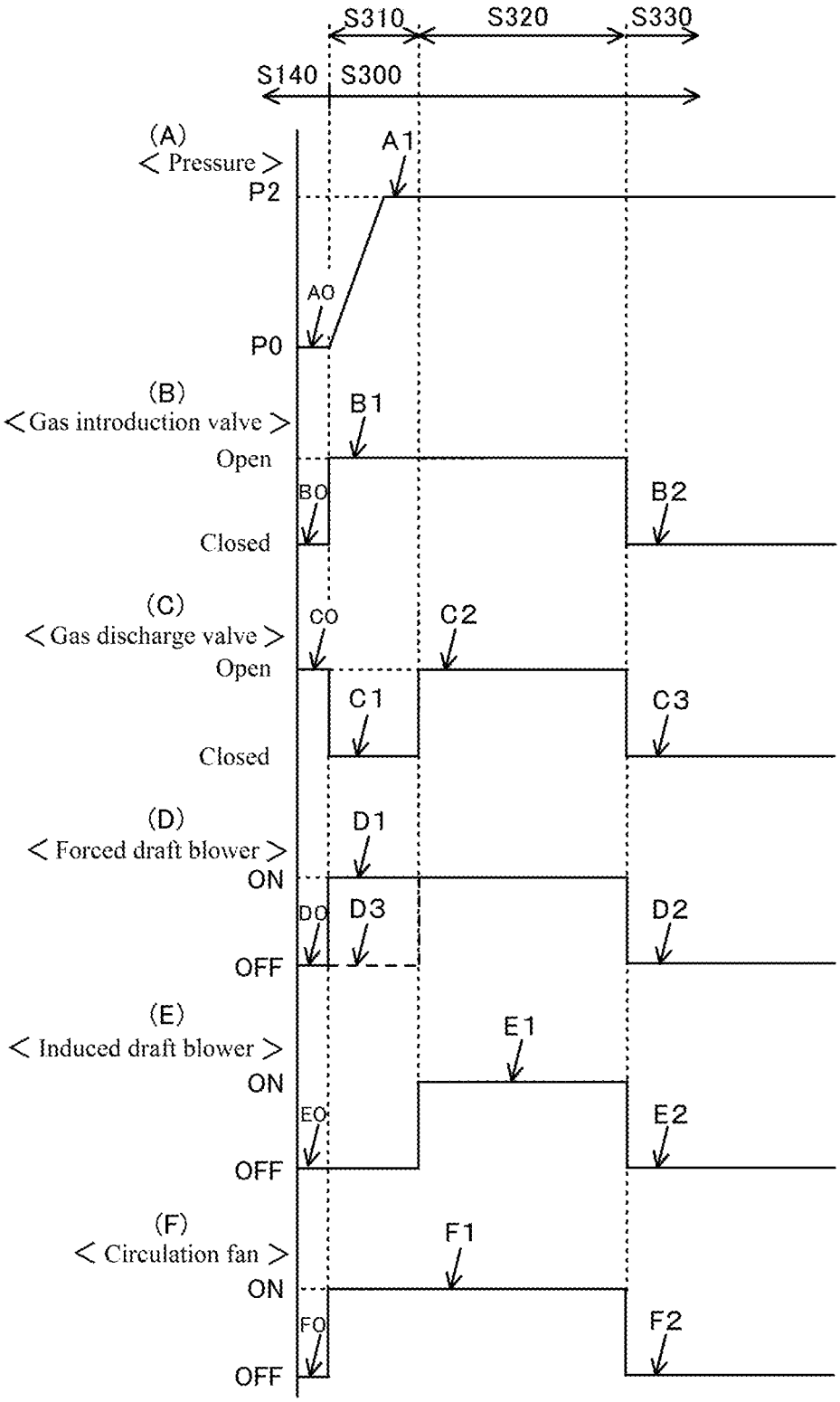
FIG. 7 is a timing chart showing the relationship among (A) change in the internal pressure of the closed container, (B) opening/closing timing for the gas introduction valve, (C) opening/closing timing for the gas discharge valve, (D) on/off timing for the forced draft blower, (E) on/off timing for the induced draft blower and (F) on/off timing for the circulation fan in the modified example of the second embodiment.

FIG. 7 is a timing chart showing the relationship among (A) change in the internal pressure of the closed container (10) (measured by the pressure measurement unit (61)), (B) opening/closing timing for the gas introduction valve (92), (C) opening/closing timing for the gas discharge valve (82), (D) on/off timing for the forced draft blower (93), (E) on/off timing for the induced draft blower (83) and (F) on/off timing for the circulation fan (71) from the final stage of the fourth step (S140) described before to the fifth step (S300). The following is a detailed description of the final stage of the fourth step and the fifth step.

(Final Stage of the Fourth Step)

In the example in FIG. 7, the fourth step (S140), when reducing the gas pressure in the closed container (10) to 70 kPa or less (see pressure P0, state A0 in (A)), closes the gas introduction valve (92) (see state B0 in (B)) and opens the gas discharge valve (82) (see state C0 in (C)). The forced draft blower (93), the induced draft blower (83) and the circulation fan (71) are off (see state D0 in (D), state E0 in (E) and state F0 in (F)) because these are not used. The outside air admittance valve (not illustrated) is closed.

(Fifth Step)

(Low-Steam Gas Introduction Step)

Next, the low-steam gas introduction step (S310) included in the fifth step (S300) starts. The example in FIG. 7 closes the gas discharge valve (82) (see state C1 in (C)) and opens the gas introduction valve (92) (see state B1 in (B)). At the same time, the circulation fan (71) can be turned on (see state F1 in (F)). The forced draft blower (93) can be turned on (see state D1 in (D)) or remain off (see state D3 in (D)). Through these actions, the low-steam gas introduction step introduces low-steam gas into the closed container (10) and temporarily keeps the introduced low-steam gas confined in the closed container (10), raising the gas pressure in the closed container (10) to the outside air pressure level P2 (see state A1 in (A)). The low-steam gas, introduced into the closed container (10) and temporarily kept confined therein, comes into sufficient contact with the coated steel sheets (1) and removes sufficient heat from the coated steel sheets (1) through heat exchange. When the gas pressure in the closed container (10) has reached outside air pressure level P2, the outside air admittance valve (not illustrated) is opened.

(Low-Steam Gas Introduction/Atmospheric Gas Discharge Step)

Next, the low-steam gas introduction/atmospheric gas discharge step (S320) starts. This step opens the gas discharge valve (82) (see state C2 in (C)) and turns on the induced draft blower (83) (see state E1 in (E)). If the forced draft blower (93) was off in the low-steam introduction step described above, the low-steam gas introduction/atmospheric gas discharge step (S320) turns on the forced draft blower (93). Through these actions, the low-steam gas introduction/atmospheric gas discharge step maintains the gas pressure in the closed container (10) at the outside air pressure level (see state A1 in (A)). Thus, the introduction of low-steam gas into the closed container (10) and the discharge of atmospheric gas (containing low-steam gas) from the closed container (10) are performed simultaneously, maintaining the gas pressure in the closed container (10) at the outside air pressure level.

(Finish Step)

Next, the finish step (S330) starts. This step closes the gas introduction valve (92) and the gas discharge valve (82) (see state B2 in (B) and state C3 in (C)), and turns off the forced draft blower (93), the induced draft blower (83) and the circulation fan (71) (see state D2 in (D), state E2 in (E) and state F2 in (F)). With the inside of the closed container (10) exposed to the outside air, the fifth step ends (see state A1 in (A)).

Effects of the Modified Example of the Second Embodiment

The modified example of the second embodiment introduces low-steam gas into the closed container (10) with the help of the forced draft blower (93) and simultaneously discharges atmospheric gas from the closed container (10) with the help of the induced draft blower (83). This increases the amount of low-steam gas flowing into and out of the closed container (10), intensifying the heat removal and quickening the cooling of the coated steel sheets (1). The stirring of atmospheric gas (containing low-steam gas) by the circulation fan (71) further improves the quick, effective and uniform cooling of the coated steel sheets (1).

For effective cooling, the preference is to install both a forced draft blower (93) and an induced draft blower (83). However, it is possible to omit one of the blowers.

In the embodiments described above, the present invention is applied to the manufacturing of black coated steel sheets, but it can be applied to the manufacturing of steam-treated products other than black coated steel sheets.

INDUSTRIAL APPLICABILITY

The present invention can reduce the manufacturing time of steam-treated products such as black coated steel sheets, leading to increased popularity of steam-treated products such as black coated steel sheets.

REFERENCE SIGNS LIST

1 Coated steel sheets
10 Closed container
30, 80 Gas discharge regulation mechanism (coolant gas discharge means)
37 Gas discharge pumps
40 Steam introduction regulation mechanism (steam introduction means)
50, 90 Gas introduction part (coolant gas introduction means)
70 Stirring unit
71 Circulation fan
83 Induced draft blower
93 Forced draft blower

What is claimed is:

1. A method for manufacturing steam-treated products, which involves a steam treatment step that introduces steam into a container containing a treatment object and brings the treatment object into contact with the steam, and a treated object cooling step that cools the object treated with steam in the steam treatment step, wherein said treated object cooling step includes at least following steps:

a coolant gas introduction step which introduces coolant gas into said container, until a gas pressure in the container reaches an outside air pressure level, and a coolant gas discharge step that discharges the introduced coolant gas from said container by using a gas discharge pump or gas discharge pumps after the coolant gas introduction step so that the gas pressure in said container goes below the outside air pressure level;

wherein said treated object cooling step alternately repeats said coolant gas introduction step and said coolant gas discharge step.

2. A method for manufacturing steam-treated products, comprising at least following steps:

a steam treatment step that introduces steam into a container containing a treatment object, and brings the treatment object into contact with the steam, and a treated object cooling step that cools the object treated with steam in the steam treatment step, wherein said treated object cooling step includes at least following steps:

a coolant gas introduction step which introduces coolant gas into said container, until a gas pressure in the container reaches an outside air pressure level, and a coolant gas discharge step that continues to introduce the coolant gas into the container, and simultaneously discharges the introduced gas from the container with the help of a gas discharge pump or an induced draft blower after the coolant gas introduction step so as to maintain the gas pressure in the container at the outside air pressure level.

3. The method for manufacturing steam-treated products according to claim 2, wherein said treated object cooling step uses a fan installed in said container that stirs and circulates the coolant gas in said container.

* * * * *